US007743955B2

(12) United States Patent
Nishikawa et al.

(10) Patent No.: US 7,743,955 B2
(45) Date of Patent: Jun. 29, 2010

(54) COMBUSTION TYPE POWER TOOL HAVING FAN

(75) Inventors: Tomomasa Nishikawa, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 692 days.

(21) Appl. No.: 11/028,538

(22) Filed: Jan. 5, 2005

(65) Prior Publication Data

US 2005/0156007 A1 Jul. 21, 2005

(30) Foreign Application Priority Data

Jan. 16, 2004 (JP) ..... P2004-009266

(51) Int. Cl.
*B25C 1/08* (2006.01)

(52) U.S. Cl. ..... 227/9; 227/8; 227/10; 123/46 SC

(58) Field of Classification Search ..... 227/8–10; 123/46 SC, 146 R, 146.5, 143 R; 310/47, 310/50

See application file for complete search history.

(56) References Cited

U.S. PATENT DOCUMENTS

| | | | | |
|---|---|---|---|---|
| 2,127,628 | A | 8/1938 | Hauser | |
| 2,238,749 | A | 4/1941 | Peltier | |
| 2,385,070 | A * | 9/1945 | Gant | 416/237 |
| 2,415,668 | A | 11/1947 | Barabino | |
| 4,403,722 | A | 9/1983 | Nikolich | |
| 4,483,280 | A | 11/1984 | Nikolich | |
| 4,483,473 | A | 11/1984 | Wagdy | |
| 4,483,474 | A | 11/1984 | Nikolich | |
| 4,483,659 | A | 11/1984 | Armstrong | |
| 4,522,162 | A | 6/1985 | Nikolich | |
| RE32,452 | E | 7/1987 | Nikolich | |
| 4,714,408 | A * | 12/1987 | Abe | 416/91 |
| 4,801,242 | A * | 1/1989 | Eunbong | 416/62 |
| 4,859,150 | A | 8/1989 | Takigawa | |
| 5,197,646 | A | 3/1993 | Nikolich | |
| 5,730,583 | A * | 3/1998 | Alizadeh | 416/189 |
| 6,499,942 | B1 | 12/2002 | Nonaka et al. | |
| 6,543,549 | B1 * | 4/2003 | Riedl et al. | 173/216 |
| 6,619,527 | B1 * | 9/2003 | Moeller | 227/10 |
| 6,783,045 | B2 * | 8/2004 | Shima et al. | 227/8 |
| 6,796,771 | B2 * | 9/2004 | Suzuki | 416/228 |
| 6,863,045 | B2 * | 3/2005 | Ricordi | 123/262 |
| 6,889,885 | B2 * | 5/2005 | Ohmori | 227/10 |

(Continued)

FOREIGN PATENT DOCUMENTS

| | | |
|---|---|---|
| CN | 2030655 | 1/1989 |

(Continued)

*Primary Examiner*—Rinaldi I. Rada
*Assistant Examiner*—Michelle Lopez
(74) *Attorney, Agent, or Firm*—Antonelli, Terry, Stout & Kraus, LLP.

(57) ABSTRACT

A combustion type power tool having a fan capable of providing a desirable turbulence in a combustion chamber. A fan is rotatably disposed in a combustion chamber and driven by a motor. The fan has fan blades each having a leading edge and a trailing edge. An angle of the leading edge relative to a rotational plane of the fan is approximately equal to an angle of the trailing edge relative to the rotational plane, whereby high degree of turbulence is generated from the position near the leading edge.

5 Claims, 5 Drawing Sheets

U.S. PATENT DOCUMENTS 7,043,055 B1 * 5/2006 Silver ..... 382/103

FOREIGN PATENT DOCUMENTS

| | | |
|---|---|---|
| CN | 1217967 | 6/1999 |
| CN | 2395045 | 9/2000 |
| EP | 0 913 234 | 5/1999 |
| GB | 748352 | 5/1956 |

* cited by examiner

FI
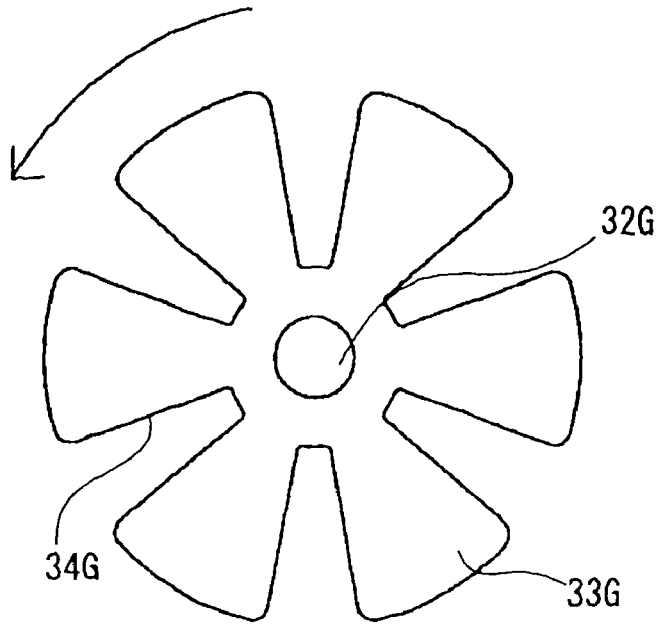
FIG. 10
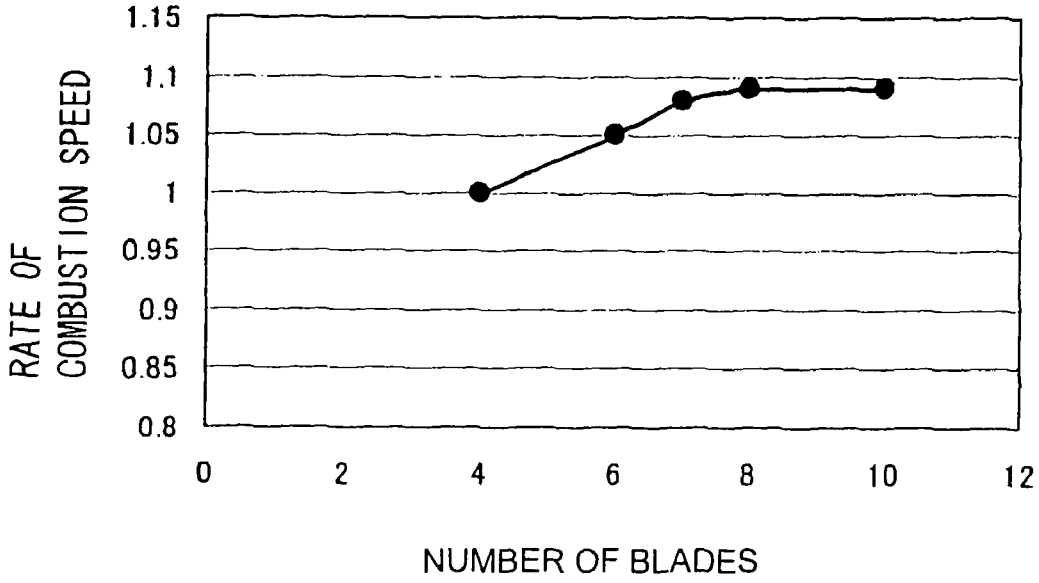

COMBUSTION TYPE POWER TOOL HAVING FAN

BACKGROUND OF THE INVENTION

The present invention relates to a combustion-type power tool, and more particularly, to such a power tool enhancing combustion efficiency.

In a conventional combustion-type driving tool such as a nail gun, a gaseous fuel injected into a combustion chamber is ignited, and the combusted fuel is agitated by an axial fan disposed in a combustion chamber to promote combustion, so that gas expansion in the combustion chamber causes a linear momentum of a piston. By the movement of the piston, a nail is driven into a workpiece. Such conventional tool is disclosed in U.S. Pat. Nos. 4,483,280 and 5,197,646.

In the above-described conventional combustion type power tool, combustion speed is increased through the agitation by the fan. Here, turbulence can be improved and accordingly combustion speed is increased by the employment of the fan in comparison with a case where no fan is provided. However, the conventional fan has a configuration to generate a smooth flow. As a result, sufficient combustion speed has not been attained, and insufficient driving energy results.

During rotation of the axial fan, the most turbulent area of the combustion gas is located at a leading edge side of each fan blade in a rotating direction of the fan. However, in the conventional combustion type power tool, a distance between neighboring leading edges of the neighboring fan blades is too large due to the shortage of the number of fan blades. Consequently, relatively long time period is required for the ignited flame having been reached one leading edge side of the fan blade to reach the next leading edge side of the next fan blade even as a result of immediate start of combustion and expansion. Thus, combustion speed through an entire space of the combustion chamber may be lowered, to render the driving energy insufficient.

SUMMARY OF THE INVENTION

It is therefore an object of the present invention to provide a combustion type power tool having a fan capable of forming a desirable turbulence within a combustion chamber.

These and other objects of the present invention will be attained by a combustion-type power tool providing a combustion chamber including a motor, and a fan rotatably positioned in the combustion chamber and rotatably driven by the motor. The fan has a plurality of fan blades defining an imaginary rotation plane, and each fan blade has a leading edge and a trailing edge in a rotational direction of the fan. An angle between the leading edge and the rotation plane is substantially equal to an angle between the trailing edge and the rotational plane.

In another aspect of the invention, there is provided a combustion-type power tool providing a combustion chamber including a motor, and a fan rotatably positioned in the combustion chamber and driven by the motor. The fan has a plurality of fan blades defining an imaginary rotation plane and each fan blade has a leading edge and a trailing edge in a rotational direction of the fan. An angle between the leading edge and the rotation plane is greater than an angle between the trailing edge and the rotational plane.

In still another aspect of the invention there is provided a combustion-type power tool providing a combustion chamber including a motor, and a fan rotatably positioned in the combustion chamber and driven by the motor. The fan has a plurality of fan blades defining an imaginary rotation plane, and each fan blade has a leading edge. An angle between the leading edge and the rotation plane being not less than 15 degrees.

In still another aspect of the invention there is provided a combustion-type power tool providing a combustion chamber including a motor, and a fan rotatably positioned in the combustion chamber and driven by the motor. The fan has a plurality of fan blades each having a bending edge portion.

In still another aspect of the invention there is provided a combustion-type power tool providing a combustion chamber including a motor, and a fan rotatably positioned in the combustion chamber and driven by the motor. The fan has a plurality of fan blades each having a front surface and a rear surface, and a through-hole extending between the front surface and the rear surface is formed in each fan blade.

In still another aspect of the invention there is provided a combustion-type power tool providing a combustion chamber including a motor, and a fan rotatably positioned in the combustion chamber and driven by the motor. The fan has a plurality of fan blades each provided with a protrusion.

With these arrangements, degree of turbulence of the combustion gas containing a fuel injected in the vicinity of the fan can be increased, so that the combustion speed near the fan is increased during the progress of combustion after ignition of the combustible gas.

In still another aspect of the invention there is provided a combustion-type power tool providing a combustion chamber comprising a motor, a fan rotatably positioned in the combustion chamber and driven by the motor. The fan includes not less than six fan blades. Preferably, the number of the fan blades is not more than eight. Since the number of leading edges of the fan blades in a rotational direction thereof is increased, turbulence generating regions on the rotational plane of the fan can be increased. Therefore, the combustion speed near the fan is increased during the progress of combustion after ignition of the combustible gas. Further, an upper limit of the number of the fan blades is defined in view of saturation of the effect of the numbers.

In still another aspect of the invention, the above described arrangements of the fans are applied to a combustion-type power tool including a housing, a head section, a push lever, a cylinder, a piston, a combustion-chamber frame, the motor, and an ignition plug. The head section closes one end of the housing and is formed with a fuel passage. The push lever is provided to the lower side of the housing and is movable upon pushing onto a workpiece. The cylinder is secured to an inside of the housing. The piston is slidably disposed in the cylinder and is reciprocally movable in an axial direction of the cylinder. The piston divides the cylinder into an upper cylinder space above the piston and a lower cylinder space below the piston. The combustion-chamber frame is provided in the housing and is movable along the cylinder. The combustion-chamber frame has one end abuttable on and separable from the head section in interlocking relation to the movement of the push lever. A combination of the combustion-chamber frame, the head section and the cylinder space above the piston defining a combustion chamber. The motor is disposed at the head section. The ignition plug is provided at the head section and is exposed to the combustion chamber.

BRIEF DESCRIPTION OF THE DRAWINGS

In the drawings;

FIG. 9 is a perspective view showing a configuration of a fan in a combustion type nail driving tool according to a seventh embodiment; and FIG. 10 is a graphical representation showing the relationship between the number of fan blades and combustion speed in the combustion type nail driving tool according to the seventh embodiment.

DETAILED DESCRIPTION OF THE PREFERRED EMBODIMENTS

Figure 1:
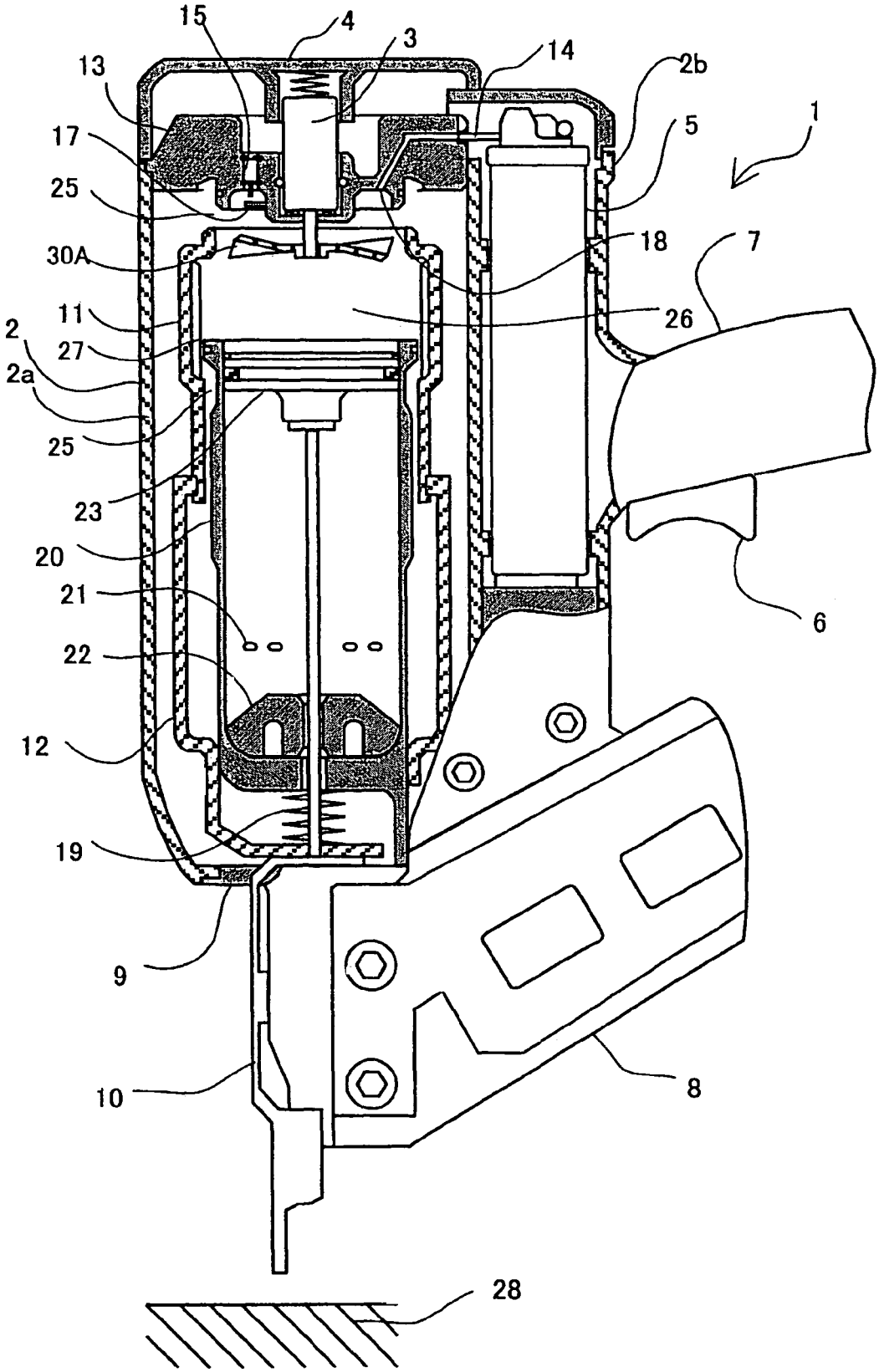
FIG. 1 is a cross-sectional view showing a combustion type nail driving tool according to a first embodiment of a combustion type power tool of the present invention and showing a state prior to nail driving operation.
Figure 2:
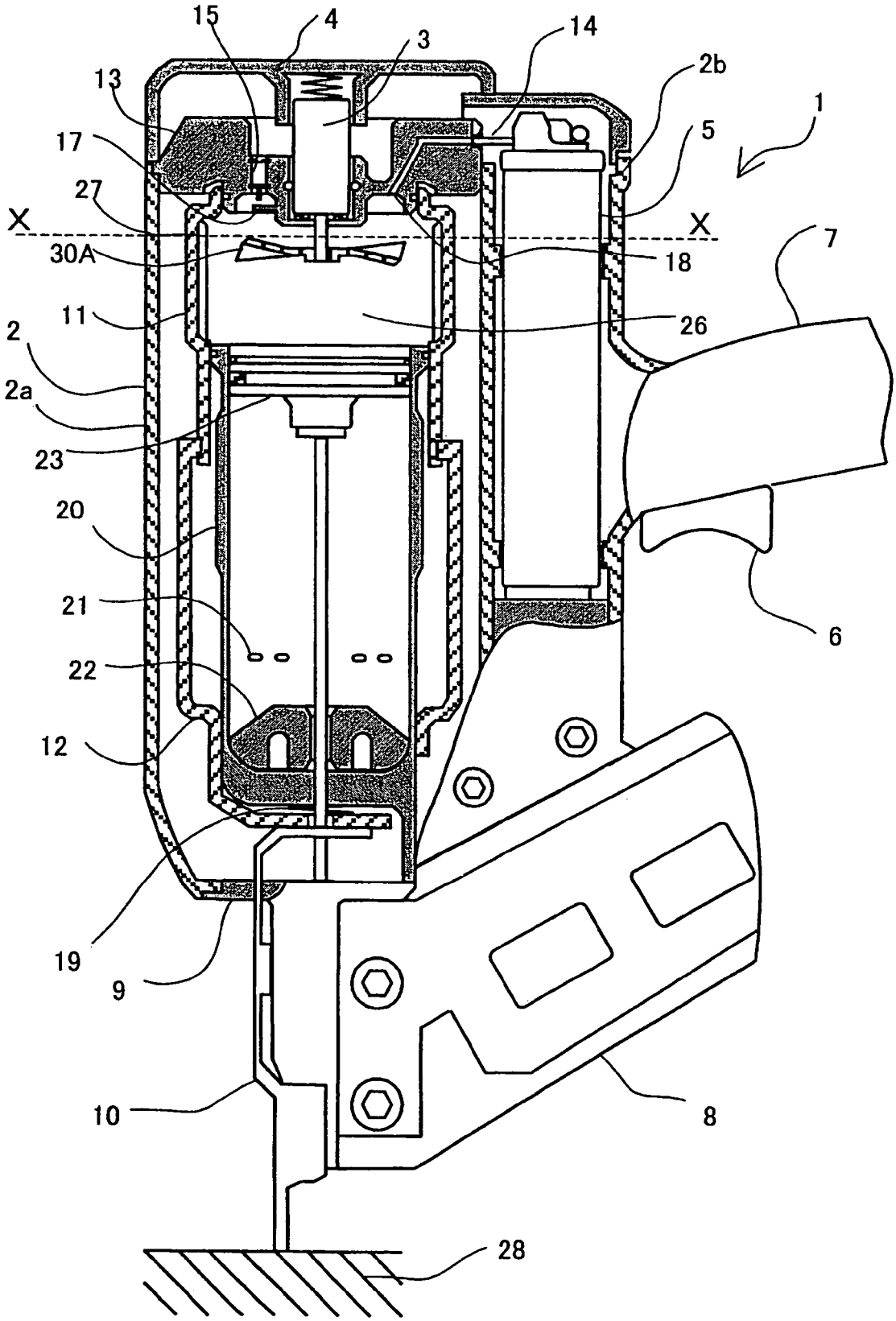
FIG. 2 is a cross-sectional view showing the combustion type nail driving tool according to the first embodiment, and showing the state where a sealed combustion chamber is provided.

A combustion-type power tool according to a first embodiment of the present invention will be described with reference to FIGS. 1 through 3. The embodiment pertains to a combustion type nail gun. The combustion type nail gun 1 has a housing 2 constituting an outer frame and including a main housing 2*a* and a canister housing 2*b* juxtaposed to the main housing 2*a*. In the following description, nail driving direction and a direction opposite thereto will be referred to as a lower side, and an upper side, respectively.

A head cover 4 formed with an intake port (not shown) is mounted on the top of the main housing 2*a*, and a gas canister 5 containing therein a combustible liquidized gas is detachably disposed in the canister housing 2*b*. A handle 7 extends from the canister housing 2*b*. The handle 7 has a trigger switch 6 and accommodates therein a battery (not shown). A magazine 8 and a tail cover 9 are provided on the bottoms of the main housing 2*a* and canister housing 2*b*. The magazine 8 contains nails (not shown), and the tail cover 9 is adapted to guidingly feed each nail in the magazine 8 and set the nail to a predetermined position.

A head cap 13 serving as a head section is secured to the top of the main housing 2*a* and closes the open top end of the main housing 2*a*. The head cap 13 supports a motor 3 having a motor shaft 16. A fan 30A such as an axial fan is coaxially fixed to the motor shaft 16. The head cap 13 also supports an ignition plug 15 ignitable upon manipulation to the trigger switch 6.

The head cap 13 has a canister housing 2*b* side in which is formed a fuel ejection passage 14 which allows a combustible gas to pass therethrough. One end of the ejection passage 14 serves as an ejection port 18 that opens at the lower surface of the head cap 13. Another end of the ejection passage 14 serves as a gas canister connecting portion in communication with the gas canister 5.

A push lever 10 is movably provided at the lower end of the main housing 2*a* and is positioned in conformance with a nail setting position defined by the tail cover 9. The push lever 10 is coupled to a coupling member 12 that is secured to a combustion-chamber frame 11 which will be described later. A compression coil spring 19 is interposed between the coupling member 12 and a cylinder 20 (described later) for urging the combustion chamber frame 11 in a direction away from the head cap 13. When the entire housing 2 is pressed toward a workpiece 28 while a tip end of the push lever 10 is in abutment with the workpiece 28 against the biasing force of the compression coil spring 19, an upper portion of the push lever 10 is retractable into the main housing 2*a*.

A head switch (not shown) is provided in the main housing 2*a* for detecting an uppermost stroke end position of the combustion chamber frame 11 when the power tool 1 is pressed against the workpiece 28. Thus, the head switch can be turned ON when the push lever 10 is elevated to a predetermined position for starting rotation of the motor 3, thereby starting rotation of the fan 30A.

The combustion-chamber frame 11 is provided in the main housing 2*a* and is movable in the lengthwise direction of the main housing 2*a*. The uppermost end of the combustion-chamber frame 11 is abuttable on the lower surface of the head cap 13. The coupling member 12 described above is secured to the lower end of the combustion-chamber-frame 11 and is connected to the push lever 10. Therefore, the combustion chamber frame 11 is movable in interlocking relation to the push lever 10. The cylinder 20 is fixed to the main housing 2*a*. An outer peripheral surface of the cylinder 20 is in sliding contact with the inner circumference of the combustion-chamber frame 11 for guiding the movement of the combustion-chamber frame 11. The cylinder 20 has an axially intermediate portion formed with an exhaust hole 21. An exhaust-gas check valve (not shown) is provided to selectively close the exhaust hole 21. Further, a bumper 22 is provided at the bottom of the cylinder 20.

A piston 23 is slidably and reciprocally provided in the cylinder 20. The piston 23 divides an inner space of the cylinder 20 into an upper space above the piston 23 and a lower space below the piston 23. When the upper end of the combustion-chamber frame 11 abuts on the head cap 13, the head cap 13, the combustion-chamber frame 11, and the upper cylinder space above the piston 23 define in combustion a combustion chamber 26. When the combustion chamber frame 11 is separated from the head cap 13, a first flow passage 24 in communication with the atmosphere is provided between the head cap 13 and the upper end of the combustion chamber frame 11, and a second flow passage 25 in communication with the first flow passage 24 is provided between the lower end portion of the combustion chamber frame 11 and the upper end portion of the cylinder 20. The second flow passage 25 allows a combustion gas and a fresh air to pass along the outer peripheral surface of the cylinder 20 for discharging these gas through an exhaust port (not shown) of the main housing 2*a*. Further, the above-described intake port is formed for supplying a fresh air into the combustion chamber 26, and the exhaust hole 21 is adapted for discharging combustion gas generated in the combustion chamber 26.

The fan 30A, the ignition plug 15, and the fuel ejection port 18 are all disposed in or open to the combustion chamber 26. Further, a ground area 17 of the ignition plug 15 is positioned at the side of the combustion chamber 26 for defining an ignition position. Rotation of the fan 30A in cooperation with ribs 27 protruding toward the combustion chamber 26 performs the following three functions. First, the fan stirs and mixes the air with the combustible gas as long as the combustion-chamber frame 11 remains in abutment with the head cap 13. Second, after the mixed gas has been ignited, the fan causes turbulence of the air-fuel mixture, thus promoting the combustion of the air-fuel mixture in the combustion chamber 26. Third, the fan performs scavenging such that the exhaust gas in the combustion chamber 26 can be scavenged therefrom and also performs cooling to the combustion chamber frame 11 and the cylinder 20 when the combustion-chamber frame 11 moves away from the head cap 13 and when the first and second flow passages 24, 25 are provided.

A driver blade 29 extends downwards from a side of the piston 23, the side being at the cylinder space below the piston, to the lower end of the main housing 2*a*. The driver blade 29 is positioned coaxially with the nail setting position in the tail cover 9, so that the driver blade 29 can strike against the nail during downward movement of the piston 23. When the piston 23 moves downward, the piston 23 abuts on the bumper 22 and stops. In this case, the bumper 22 absorbs a surplus energy of the piston 23.

Figure 3:
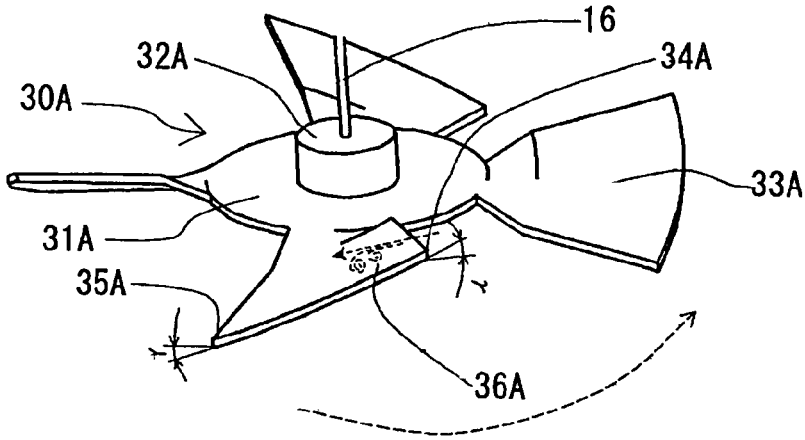
FIG. 3 is a perspective view showing a configuration of a fan in the combustion type nail driving tool according to the first embodiment.

As shown in FIG. 3, the fan 30A includes a fan boss 32A coupled to the rotation shaft 16, and four fan blades disposed radially from an outer peripheral surface of the fan boss 32A. The four fan blades is made from a single metal plate such as an aluminum plate, and includes a central disc section 31A connected to the fan boss 32A and four blade sections 33A extending from the disc section 31A in four directions. Each blade section 33A is distorted at a boundary of the disc section 31A in such a manner that a leading edge 34A of each blade section 33A is positioned upwardly from a trailing edge 35A thereof with respect to a rotational plane of the fan 30A. Further, each blade section 33A is of an approximately planar shape. Thus, an angle between the leading edge 34A and the rotational plane of the fan 30A is substantially equal to an angle between the trailing edge 35A and the rotational plane.

Operation of the combustion type nail gun 1 according to the first embodiment will next be described. Non-operational state of the combustion type nail gun 1 is shown in FIG. 1. In this state, the push lever 10 is biased downward by the biasing force of the compression coil spring 19, so that the push lever 10 protrudes from the lower end of the tail cover 9. Thus, the uppermost end of the combustion-chamber frame 11 is spaced away from the head cap 13 because the coupling member 12 couples the combustion-chamber frame 11 to the push lever 10. Further, a part of the combustion-chamber frame 11 which part defines the combustion chamber 26 is also spaced from the top portion of the cylinder 20. Hence, the first and second flow passages 24 and 25 are provided. In this condition, the piston 23 stays at the top dead center in the cylinder 20.

With this state, if the push lever 10 is pushed onto the workpiece 28 while holding the handle 7 by a user, the push lever 10 is moved upward against the biasing force of the compression coil spring 19. At the same time, the combustion-chamber frame 11 which is coupled to the push lever 10, is also moved upward, closing the above-described flow passages 24 and 25. Thus, the sealed combustion chamber 26 is provided as shown in FIG. 2.

In accordance with the movement of the push lever 10, the gas canister 5 is tilted toward the head cap 13 by an action of a cam (not shown). Thus, the injection rod (not shown) of the gas canister 5 is pressed against the connecting portion of the head cap 13. Therefore, the liquidized gas in the gas canister 5 is ejected once into the combustion chamber 26 through the ejection port 18.

Further, in accordance with the movement of the push lever 10, the combustion chamber frame 11 reaches the uppermost stroke end whereupon the head switch is turned ON to start rotation of the fan 30A. Rotation of the fan 30A and the ribs 27 protruding into the combustion chamber 26 cooperate, stirring and mixing the combustible gas with air in the combustion chamber 26 in order to form a combustion gas.

In this state, when the trigger switch 6 provided at the handle 7 is turned ON, spark is generated at the ignition plug 15 to ignite the combustible gas. The combustion gas in the combustion chamber 26 and near the ignition plug 15 provides a moderate combustion and therefore low speed combustion because the turbulence by the fan 30A is insufficient. Accordingly, in FIG. 2, degree of turbulence at a region ranging from the ignition plug 15 to a position X is low, to provide a slow combustion speed.

The position X is the rotation plane of the fan 30A. As shown in FIG. 3, because of the specific configuration of each fan blade 33A, the fan 30A is rotated in a rotational direction such that an angle of each leading edge 34A relative to the plane X is constantly maintained at an angle $\gamma$.

In a conventional fan of a conventional combustion type nail gun, an angle of each leading edge relative to the rotational plane of the fan is set not more than 15 degrees. Then, an angle between the blade surface and the rotational plane is gradually increased in a direction toward the trailing edge. As a result, smooth flow results to lower generation of turbulence. On the other hand, in accordance with the first embodiment, angle of the leading edge and an angle of the trailing edge with respect to the rotational plane are equal to each other and makes the fan blade surface in a plane configuration, because turbulent flow is required.

With this arrangement, as shown in FIG. 3, turbulence is generated at the surface 36A of the fan blade 33A and from the leading edge side 34A of each fan blade 33A. This turbulence is continuously generated and is directed from the leading edge 34A to the trailing edge 35A on the surface 36A of the fan blade 33A, and then is diffused toward the lower side of the fan 30A. During the diffusion, the turbulence generated in the combustion gas is gradually weakened. Here, the rotational plane of the fan implies a flat plane in parallel to the rotation loci of the fan blades 33A about the rotation shaft 16.

Therefore, turbulent flow is generated near the fan 30A and the combustion chamber frame 11. The flame ignited and propagated within the combustion gas is immediately and promptly burned at a position where the turbulence is generated after the flame reaches the fan 30A, and this combustion is promptly propagated through the combustion chamber 26. Thus, the immediate volumetric expansion of the combustion gas occurs within the combustion chamber 26 to move the piston 23 downwardly. Accordingly, the driver blade 29 drives the nail held in the tail cover 9 into a workpiece until the piston 23 strikes against the bumper 22.

After the nail driving, the piston 23 strikes against the bumper 22, and the combustion gas is discharged out of the cylinder 20 through the exhaust hole 21 of the cylinder 20 and through the check valve (not shown) provided at the exhaust hole 21. When the inner space of the cylinder 20 and the combustion chamber 26 becomes the atmospheric pressure, the check valve is closed. Combustion gas still remaining in the cylinder 20 and the combustion chamber 26 has a high temperature at a phase immediately after the combustion. However, the high temperature can be absorbed into the walls of the cylinder 20 and the combustion-chamber frame 11 to rapidly cool the combustion gas. Thus, the pressure in the sealed space in the cylinder 20 above the piston 23 further drops to less than the atmospheric pressure (creating a so-called "thermal vacuum"). Accordingly, the piston 23 is moved back to the initial top dead center position.

Then, the trigger switch 6 is turned OFF, and the user lifts the combustion type nail gun from the workpiece 28 for separating the push lever 10 from the workpiece 28. As a result, the push lever 10 and the combustion-chamber frame 11 move downward due to the biasing force of the compression coil spring 19 to restore a state shown in FIG. 1. In this case, the fan 30A keeps rotating for a predetermined period of time in spite of OFF state of the trigger switch 6 because of an operation of a control portion (not shown). In the state shown in FIG. 1, the flow passages 24 and 25 are provided again at the upper and lower sides of the combustion chamber, so that fresh air flows into the combustion chamber 26 through the intake port and through the flow passages 24, 25, expelling the residual gas through the exhaust port (not shown) by the rotation of the fan 30A. Thus, the combustion chamber 26 is scavenged. Then, the rotation of the fan 30A is stopped to restore an initial stationary state. Thereafter, subsequent nail driving operation can be performed by repeating the above described operation process.

As described above, in the combustion type nail gun 1, expansion of the gas in the combustion chamber 26 is used as a power source for driving a nail. Thus, according to the first embodiment, combustion speed of the combustion gas is increased, and efficient heat generation and expansion results because of the particular configuration of the fan blades, to enhance driving performance and operability.

Figure 4:
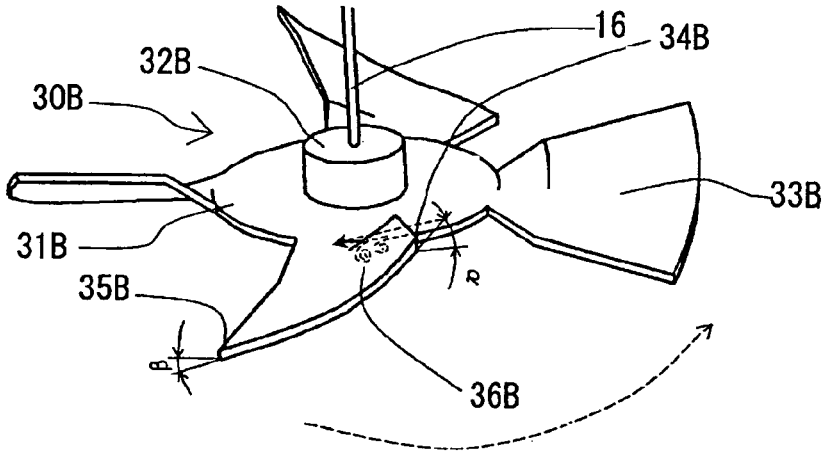
FIG. 4 is a perspective view showing a configuration of a fan in a combustion type nail driving tool according to a second embodiment.

A second embodiment will be described with reference to FIG. 4. In a fan 30B according to the second embodiment, an angle $\alpha$ of a leading edge 34B of a fan blade 33B relative to a rotational plane of the fan 30B is set greater than an angle $\beta$ of a trailing edge 35B of the fan blade relative to the rotational plane ($\alpha>\beta$). With this arrangement, the degree of turbulence generated from the leading edge 34B at the surface 36B of the fan blade 33B can be improved. Thus, more efficient combustion can result. Incidentally, in the second embodiment, a coupling structure of the fan to the rotation shaft, and remaining construction of the combustion-type driving tool and its operation are the same as those of the first embodiment.

Figure 5:
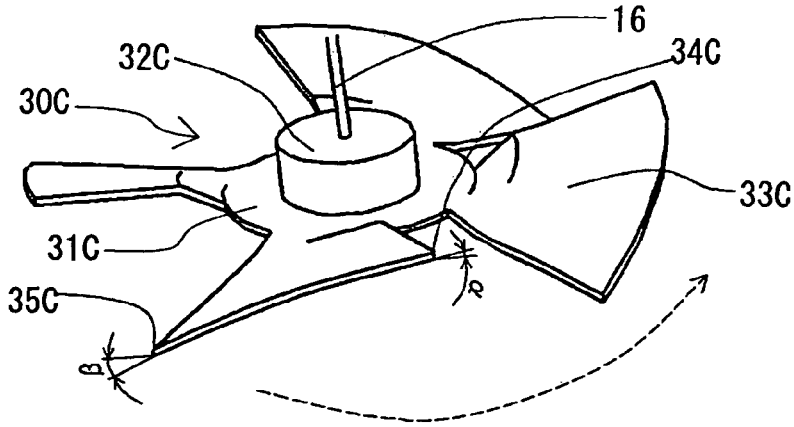
FIG. 5 is a perspective view showing a configuration of a fan in a combustion type nail driving tool according to a third embodiment.

A third embodiment will be described with reference to FIG. 5. In a fan 30C according to the third embodiment, an angle $\alpha$ of a leading edge 34C of a fan blade 33C relative to a rotational plane of the fan 30C is not less than 15 degrees. As described above, in the conventional fan blade arrangement in the conventional combustion-type faster driving tool, an angle of the leading edge of the fan blade relative to the rotational plane is less than 15 degrees. In contrast, in the present embodiment, the angle is not less than 15 degrees. With this arrangement, the degree of turbulence generated from the leading edge 34C at the surface 36C of the fan blade 33C can be improved. Thus, degree of turbulence is enhanced in comparison with an ordinary fan, so that more efficient combustion can result. Incidentally, in the third embodiment, a coupling structure of the fan to the rotation shaft, and remaining construction of the combustion-type driving tool and its operation are the same as those of the first embodiment.

Figure 6:
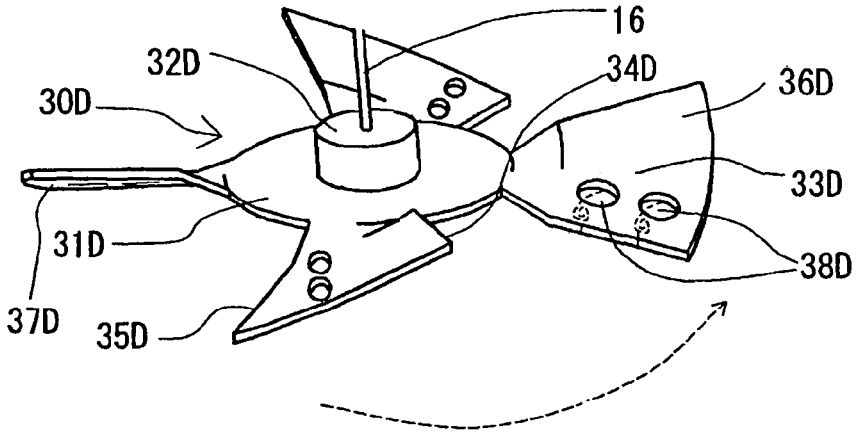
FIG. 6 is a perspective view showing a configuration of a fan in a combustion type nail driving tool according to a fourth embodiment.

A fourth embodiment will be described with reference to FIG. 6. In a fan 30D of the fourth embodiment, through holes 38D extending between a font surface 26D and a rear surface 37D are formed near a trailing edge 35D of each fan blade 33D. During rotation of the fan 30D, level of pressure of gas containing a combustion gas within the combustion chamber 26 and applied to the rear surface 37D is greater than that applied to the front surface 36D. Thus, gas flows through the through-holes 38D from the rear surface 37D to the front surface 36D. This gas flow flowing through the through-holes 38D is converged with the turbulent flow generated at the leading edge 34D and flowing on the front surface 36D. Turbulence is further formed at the converging position.

The turbulent flow generated at the leading edge 34D is flowed toward the trailing edge 35D on the front surface 36D. In this case, the turbulence is gradually weakened. However, the degree of turbulence is again enhanced because the turbulence is again generated near the trailing edge 35D and on the front surface 36D. Thus, efficient combustion can result. Incidentally, in the fourth embodiment, a coupling structure of the fan to the rotation shaft, and remaining construction of the combustion-type driving tool and its operation are the same as those of the first embodiment. Further, the position of the through-holes 38D is not limited to near the trailing edge 35D of the fan blade 33D, but to a portion other than near the trailing edge 35D.

Figure 7:
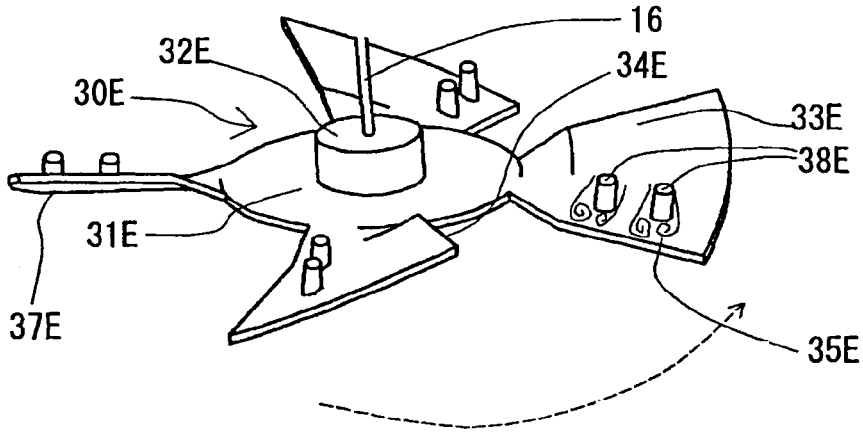
FIG. 7 is a perspective view showing a configuration of a fan in a combustion type nail driving tool according to a fifth embodiment.

A fifth embodiment will be described with reference to FIG. 7. Protrusions 39E protruding from a front surface 36E and in a direction approximately perpendicular to the rotational plane are provided near a trailing edge 35E of each fan blade 33E. Generally, if the protrusion is provided on the rotational plane, turbulence is generated at an downstream side of the protrusion in the rotational direction. Thus, in the present embodiment, turbulence is generated at an downstream side of the protrusions 39E in the rotational direction. The turbulent flow generated at the leading edge 34E will impinge on the protrusions 39E, to further disturb the flow. Thus, the degree of turbulence is further enhanced. Thus, efficient combustion can result. Incidentally, in the fifth embodiment, a coupling structure of the fan to the rotation shaft, and remaining construction of the combustion-type driving tool and its operation are the same as those of the first embodiment. Further, the position of the protrusions 39E is not limited to the front surface 36E of the fan blade 33E, but the protrusions can be provided at the rear surface 37E of the fan blade or both the front and rear surfaces. Furthermore, the position of the protrusions 39E is not limited to near the trailing edge 35E, but can be positioned other than near the trailing edge 35E.

Figure 8:
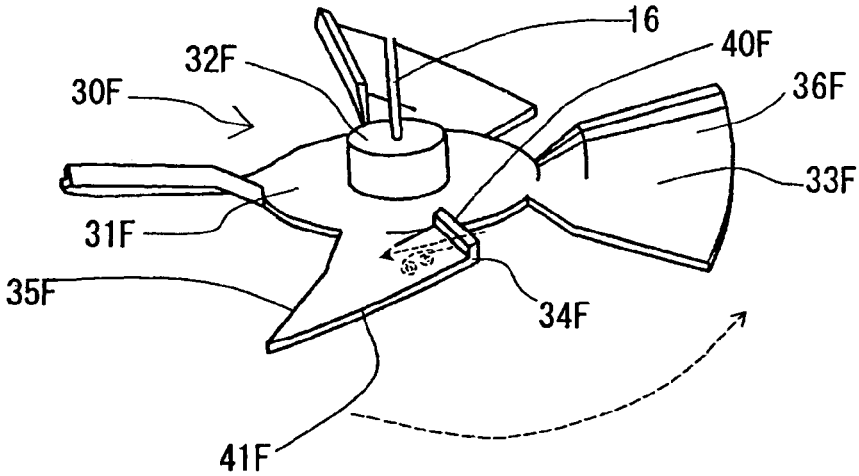
FIG. 8 is a perspective view showing a configuration of a fan in a combustion type nail driving tool according to a sixth embodiment.

A sixth embodiment will be described with reference to FIG. 8. A fold-up section 40F is provided by bending a leading edge portion 34F of the fan blade 33F toward the front surface 36F of the fan blade 33E. Generation of turbulence at a position ranging from an immediate upstream side of the fold-up section 40F to the leading edge area in the rotational direction of the fan blade 33F is increased. Thus, efficient combustion can result. As a modification, additional fold-up section can also be provided at the trailing edge 35F in addition to the leading edge. Further, additional fold-up section can also be provided at an outer peripheral edge 41F of the fan 30F. Incidentally, in the sixth embodiment, a coupling structure of the fan to the rotation shaft, and remaining construction of the combustion-type driving tool and its operation are the same as those of the first embodiment.

A seventh embodiment will be described with reference to FIG. 9. A fan 30G includes six fan blades 33G. Generally, turbulent flow is generated from the leading edge of the fan blade, and the turbulent flow flows along the surface of the fan blade and is directed downward of the fan blade. The turbulent flow is diffused into the combustion chamber. Thus, the number of turbulence generating regions is increased in accordance with an increase in the number of fun blades. Consequently, degree of turbulence is improved. Thus, efficient combustion can result.

FIG. 10 shows the relationship between the number of fan blades and the combustion speed. Even though the combustion speed can be increased in accordance with the improvement on turbulence by increasing the number of fan blades, production or machining steps is increased. However, as is apparent from FIG. 10, increase in combustion speed cannot be recognized even if the number of fan blades is increased to not less than 8. Thus, not more than 8 fan blades can improve combustion performance without inadvertently increasing production steps. Incidentally, in the seventh embodiment, a coupling structure of the fan to the rotation shaft, and remaining construction of the combustion-type driving tool and its operation are the same as those of the first embodiment.

While the invention has been described in detail and with reference to the specific embodiments thereof, it would be apparent to those skilled in the art that various changes and modifications may be made therein without departing from the sprit and scope of the invention. For example, as described above, the fans 30A, 30B and 30C according to the first through third embodiments can improve the generation of turbulence by suitably arranging configuration of a fan blade. On the other hand, the fans 30D, 30E, 30F according to the fourth through sixth embodiments can improve the generation of turbulence by machining the fan blade. Therefore, at least one of the machining achieved in one of the fans 30D, 30E, 30F can be effected to one of the fans 30A, 30B and 30C.

Further, in the seventh embodiment, six fan blades 33G are provided. However, this blade number is available to one of the fans 30A through 30F of the first through sixth embodiments, or to the fan according to the above described modifications. With such arrangement, the effect brought by the configuration or machining of the fan blade and the effect of the number of the fan blades provides a synergetic effect to generate more improved turbulence to increase the combustion speed, thereby improving kinetic energy of the piston. Further, the increase in number of the fan blades in the ordinary fan can still improve the turbulence.

What is claimed is:

1. A combustion-type power tool providing a combustion chamber comprising:

a housing having one end and a lower side;

a head section closing the one end of the housing and formed with a fuel passage;

a push lever provided to the lower side of the housing and movable upon pushing onto a workpiece;

a cylinder secured to an inside of the housing;

a piston slidably disposed in the cylinder and reciprocally movable in an axial direction of the cylinder, the piston dividing the cylinder into an upper cylinder space above the piston and a lower cylinder space below the piston;

a combustion-chamber frame provided in the housing and movable along the cylinder, the combustion-chamber frame having one end abuttable on and separable from the head section in interlocking relation to the movement of the push lever, a combination of the combustion-chamber frame, the head section and the cylinder space above the piston defining the combustion chamber;

an ignition plug provided at the head section and exposed to the combustion chamber;

a motor; and a fan rotatably positioned in the combustion chamber and driven by the motor so as to be rotatable about a rotation shaft, the fan having a ring portion extending in a direction perpendicular to the rotation shaft and fan blades each having a leading edge and a trailing edge;

wherein the leading edge of each fan blade extends from the surface of the ring portion in a rotational direction and the trailing edge of each fan blade extends from the surface of the ring portion in a counter rotational direction;

wherein a first angle ($\alpha$) between the leading edge and the surface of the ring portion is greater than 0° and substantially equal to a second angle ($\beta$) between the trailing edge and the surface of the ring portion which is greater than 0°, the first angle ($\alpha$) being an angle which is not less than 15 degrees; and wherein the fan is configured so as to enable an increase in degree of turbulence of a combustion gas contained in a fuel injected in the vicinity of the fan and an increase in combustion speed during progress of combustion after ignition of the combustion gas so as to enable an improved operation of the combustion-type power tool.

2. The combustion-type power tool as claimed in claim 1, wherein the fan comprises from six to eight fan blades.

3. The combustion-type power tool as claimed in claim 1, wherein each fan blade has a substantially planar shape.

4. A combustion-type power tool providing a combustion chamber comprising:

a housing having one end and a lower side;

a head section closing the one end of the housing and formed with a fuel passage;

a push lever provided to the lower side of the housing and movable upon pushing onto a workpiece;

a cylinder secured to an inside of the housing;

a piston slidably disposed in the cylinder and reciprocally movable in an axial direction of the cylinder, the piston dividing the cylinder into an upper cylinder space above the piston and a lower cylinder space below the piston;

a combustion-chamber frame provided in the housing and movable along the cylinder, the combustion-chamber frame having one end abuttable on and separable from the head section in interlocking relation to the movement of the push lever, a combination of the combustion-chamber frame, the head section and the cylinder space above the piston defining the combustion chamber;

an ignition plug provided at the head section and exposed to the combustion chamber;

a motor; and a fan rotatably positioned in the combustion chamber and driven by the motor so as to be rotatable about a rotation shaft, the fan having a ring portion extending in a direction perpendicular to the rotation shaft and fan blades each having a leading edge and a trailing edge;

wherein the leading edge of each fan blade extends from the surface of the ring portion in a rotational direction and the trailing edge of each fan blade extends from the surface of the ring portion in a counter rotational direction;

wherein a first angle ($\alpha$) between the leading edge and the surface of the ring portion is greater than 0° and greater than a second angle ($\beta$) between the trailing edge and the surface of the ring portion which is greater than 0°, the first angle ($\alpha$) being an angle which is not less than 15 degrees; and wherein the fan is configured so as to enable an increase in degree of turbulence of a combustion gas contained in a fuel injected in the vicinity of the fan and an increase in combustion speed during progress of combustion after ignition of the combustion gas so as to enable an improved operation of the combustion-type power tool.

5. The combustion-type power tool as claimed in claim 4, wherein the fan comprises from 6 to 8 fan blades.

* * * * *